US009002216B2

(12) United States Patent
Matsumoto et al.

(10) Patent No.: US 9,002,216 B2
(45) Date of Patent: Apr. 7, 2015

(54) IMAGE FORMING APPARATUS THAT FORMS A TEST PATTERN AND CARRIES OUT CORRECTION

(71) Applicant: Canon Kabushiki Kaisha, Tokyo (JP)

(72) Inventors: So Matsumoto, Toride (JP); Kenji Suzuki, Abiko (JP); Kenichi Hirota, Joso (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/175,793

(22) Filed: Feb. 7, 2014

(65) Prior Publication Data

US 2014/0233968 A1 Aug. 21, 2014

(30) Foreign Application Priority Data

Feb. 21, 2013 (JP) ..... 2013-032445

(51) Int. Cl.
*G03G 15/00* (2006.01)

(52) U.S. Cl.
CPC ..... *G03G 15/5062* (2013.01)

(58) Field of Classification Search
USPC ..... 399/9, 15, 38, 45, 46, 49, 72
See application file for complete search history.

(56) References Cited

U.S. PATENT DOCUMENTS

| | | | | |
|---|---|---|---|---|
| 5,510,885 | A * | 4/1996 | Mori et al. | 399/28 |
| 6,959,157 | B2 | 10/2005 | Nakayama | |
| 7,068,393 | B2 | 6/2006 | Sasanuma et al. | |
| 8,553,289 | B2 * | 10/2013 | Ramesh et al. | 358/3.26 |
| 2011/0116818 | A1 * | 5/2011 | Yashima et al. | 399/45 |
| 2013/0148996 | A1 * | 6/2013 | Masui | 399/72 |

FOREIGN PATENT DOCUMENTS

| | | |
|---|---|---|
| JP | 2004-086013 A | 3/2004 |
| JP | 2009-004865 A | 1/2009 |

* cited by examiner

*Primary Examiner* — Hoan Tran
(74) *Attorney, Agent, or Firm* — Fitzpatrick, Cella, Harper & Scinto

(57) ABSTRACT

An image forming apparatus, includes an image forming unit configured to form a reference pattern and a test pattern on a sheet, a measurement unit configured to detect the reference pattern formed on the sheet and to measure the test pattern formed on the sheet, and a control unit configured to control a measurement timing of the test pattern by the measurement unit according to a detection interval between two reference patterns detected by the measurement unit.

10 Claims, 10 Drawing Sheets

FIG. 4

| PATTERN NUMBER | C | M | Y | K | ACCUMULATION SETTING | NUMBER OF TIMES AVERAGING IS CONDUCTED | PAT-TERN SIZE |
|---|---|---|---|---|---|---|---|
| 1 | 0 | 0 | 0 | 0 | 1 | 16 | 12 |
| 2 | 50 | 0 | 0 | 0 | 1 | 16 | 12 |
| 3 | 100 | 0 | 0 | 0 | 1 | 16 | 12 |
| 4 | 0 | 50 | 0 | 0 | 1 | 16 | 12 |
| 5 | 50 | 50 | 0 | 0 | 1 | 16 | 12 |
| 6 | 100 | 50 | 0 | 0 | 1 | 16 | 12 |
| 7 | 0 | 100 | 0 | 0 | 1 | 16 | 12 |
| 8 | 50 | 100 | 0 | 0 | 1 | 16 | 12 |
| 9 | 100 | 100 | 0 | 0 | 1 | 16 | 12 |
| 10 | 0 | 0 | 50 | 0 | 1 | 16 | 12 |
| 11 | 50 | 0 | 50 | 0 | 1 | 16 | 12 |
| 12 | 100 | 0 | 50 | 0 | 1 | 16 | 12 |
| 13 | 0 | 0 | 100 | 0 | 1 | 16 | 12 |
| 14 | 50 | 0 | 100 | 0 | 1 | 16 | 12 |
| 15 | 100 | 0 | 100 | 0 | 1 | 16 | 12 |
| 16 | 0 | 50 | 50 | 0 | 1 | 16 | 12 |
| 17 | 50 | 50 | 50 | 0 | 1 | 16 | 12 |
| 18 | 100 | 50 | 50 | 0 | 1 | 16 | 12 |
| 19 | 0 | 50 | 100 | 0 | 1 | 16 | 12 |
| 20 | 50 | 50 | 100 | 0 | 1 | 16 | 12 |
| 21 | 100 | 50 | 100 | 0 | 1 | 16 | 12 |
| 22 | 0 | 100 | 50 | 0 | 1 | 16 | 12 |
| 23 | 50 | 100 | 50 | 0 | 1 | 16 | 12 |
| 24 | 100 | 100 | 50 | 0 | 1 | 16 | 12 |
| 25 | 0 | 100 | 100 | 0 | 1 | 16 | 12 |
| 26 | 50 | 100 | 100 | 0 | 1 | 16 | 12 |
| 27 | 100 | 100 | 100 | 0 | 1 | 16 | 12 |
| 28 | 0 | 0 | 0 | 50 | 1 | 16 | 12 |
| 29 | 50 | 0 | 0 | 50 | 2 | 16 | 24 |
| 30 | 100 | 0 | 0 | 50 | 2 | 16 | 24 |
| 31 | 0 | 50 | 0 | 50 | 1 | 16 | 12 |
| 32 | 50 | 50 | 0 | 50 | 2 | 16 | 24 |
| 33 | 100 | 50 | 0 | 50 | 2 | 16 | 24 |
| 34 | 0 | 100 | 0 | 50 | 1 | 16 | 12 |
| 35 | 50 | 100 | 0 | 50 | 2 | 16 | 24 |
| 36 | 100 | 100 | 0 | 50 | 2 | 16 | 24 |
| 37 | 0 | 0 | 50 | 50 | 1 | 16 | 12 |
| 38 | 50 | 0 | 50 | 50 | 2 | 16 | 24 |
| 39 | 100 | 0 | 50 | 50 | 2 | 16 | 24 |
| 40 | 0 | 0 | 100 | 50 | 1 | 16 | 12 |
| 41 | 50 | 0 | 100 | 50 | 2 | 16 | 24 |
| 42 | 100 | 0 | 100 | 50 | 2 | 16 | 24 |
| 43 | 0 | 50 | 50 | 50 | 1 | 16 | 12 |
| 44 | 50 | 50 | 50 | 50 | 2 | 16 | 24 |
| 45 | 100 | 50 | 50 | 50 | 2 | 16 | 24 |
| 46 | 0 | 50 | 100 | 50 | 1 | 16 | 12 |
| 47 | 50 | 50 | 100 | 50 | 2 | 16 | 24 |
| 48 | 100 | 50 | 100 | 50 | 2 | 16 | 24 |
| 49 | 0 | 100 | 50 | 50 | 2 | 16 | 24 |
| 50 | 50 | 100 | 50 | 50 | 2 | 16 | 24 |
| 51 | 100 | 100 | 50 | 50 | 2 | 16 | 24 |
| 52 | 0 | 100 | 100 | 50 | 2 | 16 | 24 |
| 53 | 50 | 100 | 100 | 50 | 2 | 16 | 24 |
| 54 | 100 | 100 | 100 | 50 | 2 | 16 | 24 |
| 55 | 0 | 0 | 0 | 100 | 2 | 16 | 24 |
| 56 | 50 | 0 | 0 | 100 | 3 | 8 | 24 |
| 57 | 100 | 0 | 0 | 100 | 3 | 8 | 24 |
| 58 | 0 | 50 | 0 | 100 | 2 | 16 | 24 |
| 59 | 50 | 50 | 0 | 100 | 3 | 8 | 24 |
| 60 | 100 | 50 | 0 | 100 | 3 | 8 | 24 |
| 61 | 0 | 100 | 0 | 100 | 2 | 16 | 24 |
| 62 | 50 | 100 | 0 | 100 | 3 | 8 | 24 |
| 63 | 100 | 100 | 0 | 100 | 3 | 8 | 24 |
| 64 | 0 | 0 | 50 | 100 | 2 | 16 | 24 |
| 65 | 50 | 0 | 50 | 100 | 3 | 8 | 24 |
| 66 | 100 | 0 | 50 | 100 | 3 | 8 | 24 |
| 67 | 0 | 0 | 100 | 100 | 2 | 16 | 24 |
| 68 | 50 | 0 | 100 | 100 | 3 | 8 | 24 |
| 69 | 100 | 0 | 100 | 100 | 3 | 8 | 24 |
| 70 | 0 | 50 | 50 | 100 | 2 | 16 | 24 |
| 71 | 50 | 50 | 50 | 100 | 3 | 8 | 24 |
| 72 | 100 | 50 | 50 | 100 | 3 | 8 | 24 |
| 73 | 0 | 50 | 100 | 100 | 2 | 16 | 24 |
| 74 | 50 | 50 | 100 | 100 | 3 | 8 | 24 |
| 75 | 100 | 50 | 100 | 100 | 3 | 8 | 24 |
| 76 | 0 | 100 | 50 | 100 | 2 | 16 | 24 |
| 77 | 50 | 100 | 50 | 100 | 3 | 8 | 24 |
| 78 | 100 | 100 | 50 | 100 | 3 | 8 | 24 |
| 79 | 0 | 100 | 100 | 100 | 2 | 16 | 24 |
| 80 | 50 | 100 | 100 | 100 | 3 | 8 | 24 |
| 81 | 100 | 100 | 100 | 100 | 3 | 8 | 24 |

IMAGE FORMING APPARATUS THAT FORMS A TEST PATTERN AND CARRIES OUT CORRECTION

BACKGROUND OF THE INVENTION

1. Field of the Invention

The present disclosure relates to calibration techniques for ensuring color stability of image forming apparatuses.

2. Description of the Related Art

Granularity, surface uniformity, letter quality, color reproducibility (including color stability) and the like are factors involved in the picture quality of image forming apparatuses, but color reproducibility can be said to be particularly important. Humans have memories in regard to the colors they expect based on experience (in particular, for the color of human skin, blue sky, and metals and the like). These colors are called memory colors. When the color of an image that is formed is beyond the allowable range of memory colors, humans experience an undesirable sense of strangeness.

A multidimensional LUT (lookup table) called an ICC (International Color Consortium) profile exists for maintaining the color reproducibility of image forming apparatuses. By employing ICC profiles, it is possible to achieve a match between the colors of an image displayed on a display device and the colors of an image formed on a sheet by an image forming apparatus. These ICC profiles are created based on color measurements of a pattern using a measuring device.

Japanese Patent Laid-Open No. 2004-86013 proposes a measuring device that measures the color of a test pattern formed on a sheet using a spectral type color sensor. The measurement values from the color sensor are converted to spectral reflectivity, and converted to CIE Lab with consideration to tristimulus values or the like. The CIE L*a*b* color space (CIE is the International Commission on Illumination or Commission Internationale d'Eclairage) is known as a color space that is not dependent on any printing machine or printer.

To improve the measurement precision of colors when measuring the colors of a test pattern formed on a sheet while conveying the sheet in an image forming apparatus, a test pattern of a single color is sampled multiple times and the measurement values of the samplings are averaged. In this case, it is necessary to ensure that the single-color test pattern has a size required for sampling multiple times. Furthermore, the measurement positions of the test pattern formed on the sheet change relatively when there is fluctuation in the conveyance speed of the sheet. For this reason, in addition to the number of times of sampling, it is necessary to give consideration to fluctuation in the conveyance speed of the sheet for the size of each of the test patterns. In this way, when the size of the test patterns becomes large, the number of test patterns that can be formed on a single sheet is reduced.

SUMMARY OF THE INVENTION

According to an aspect of the present invention, an image forming apparatus, includes an image forming unit configured to form a reference pattern and a test pattern on a sheet, a measurement unit configured to detect the reference pattern formed on the sheet and to measure the test pattern formed on the sheet, and a control unit configured to control a measurement timing of the test pattern according to a detection interval between two reference patterns detected by the measurement unit.

Further features of the present invention will become apparent from the following description of exemplary embodiments with reference to the attached drawings.

BRIEF DESCRIPTION OF THE DRAWINGS

FIG. 4 is a diagram showing one example of various parameters of test patterns according to one embodiment.

DESCRIPTION OF THE EMBODIMENTS

Hereinafter, exemplary embodiments of the present invention are described with reference to the accompanying drawings. It should be noted that compositional elements that are not necessary to the description of the embodiment are omitted from the accompanying drawings.

First Embodiment

Hereinafter, description is given of a present embodiment according to an electrophotographic type image forming apparatus. However, the present invention can also be applied to inkjet types and sublimation types. It should be noted that image forming units that form an image on a sheet by discharging ink and fixing units (drying units) that cause ink to dry are used in inkjet types.

Figure 1:
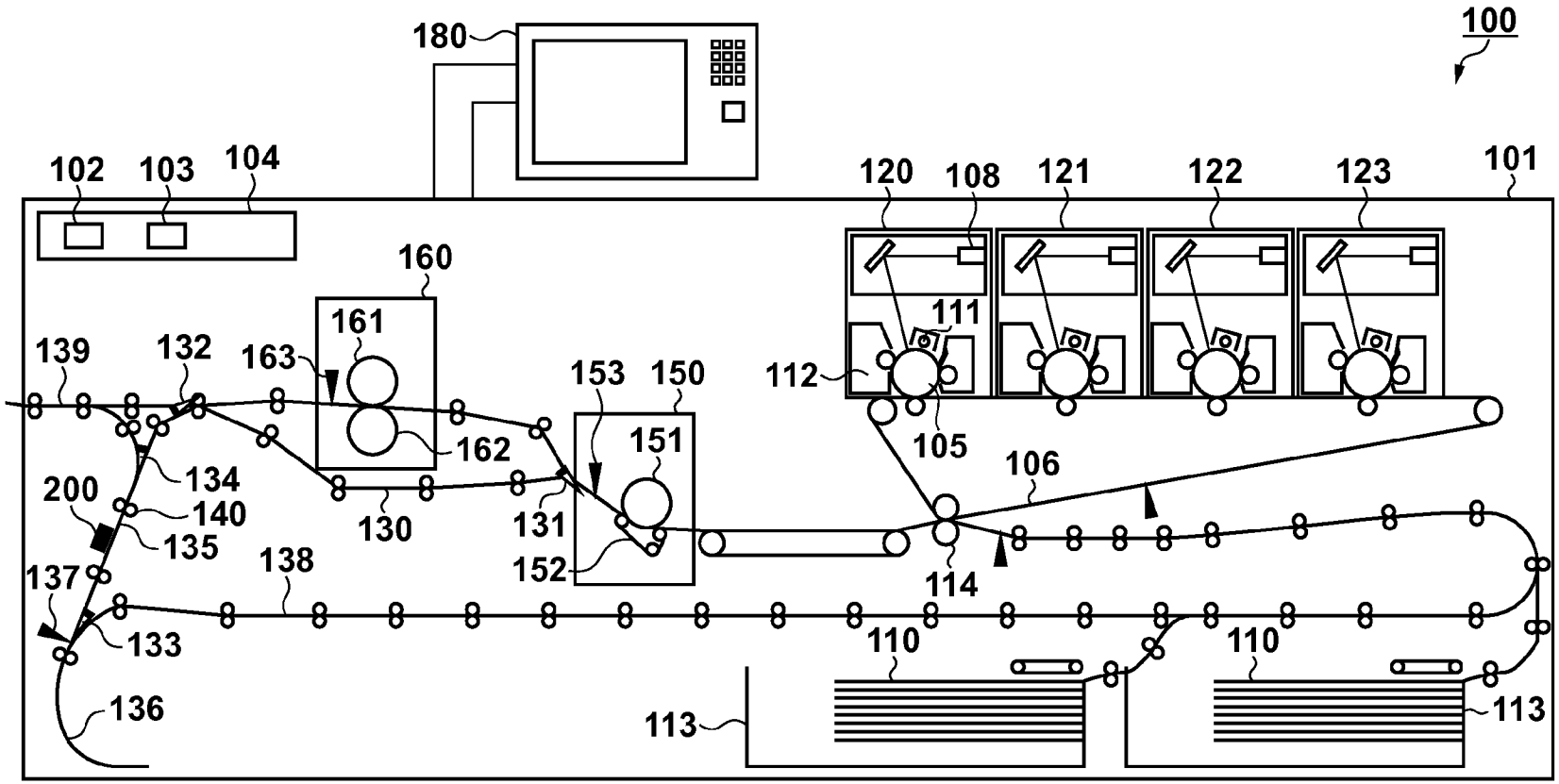
FIG. 1 is an outline structural view of an image forming apparatus according to one embodiment.

FIG. 1 is a cross-sectional view showing a structure of an image forming apparatus 100. The image forming apparatus 100 is provided with a housing 101. Arranged in the housing 101 are various mechanisms that constitute an image forming engine unit and a control board accommodation unit 104. Accommodated in the control board accommodation unit 104 are an engine control CPU 102 that carries out control relating to the processing of each print process (for example, sheet feeding processing and the like) by the various mechanisms and a printer controller 103 that carries out image processing and the like.

As shown in FIG. 1, four stations 120, 121, 122, and 123 are provided in the image forming engine unit corresponding to YMCK. Each of the stations 120, 121, 122, and 123 is an image forming unit that forms an image by transferring toner to a sheet. Here, YMCK is an abbreviation for yellow, magenta, cyan, and black. Each station is configured using substantially common components. A photosensitive drum 105 is one type of an image carrier and is charged to a uniform surface electric potential by a primary charger 111. An electrostatic latent image is formed on the photosensitive drum 105 by a laser beam outputted by a laser 108. A development device 112 develops the electrostatic latent image using a color material (toner) to form a toner image. The toner image (visible image) undergoes primary transfer onto an intermediate transfer member 106. The visible image formed on the intermediate transfer member 106 undergoes secondary transfer through a transfer roller 114 onto a sheet 110 that has been conveyed in from a storage container 113.

A fixing process mechanism according to the present embodiment is provided with a first fixing device 150 and a second fixing device 160 that apply heat and pressure to the toner image that has been transferred to the sheet 110 to fix it to the sheet 110. The first fixing device 150 includes a fixing roller 151 for applying heat to the sheet 110, a pressure belt 152 for pressing the sheet 110 onto the fixing roller 151, and a first post-fixing sensor 153 for detecting the completion of fixing. The fixing roller 151 is a hollow roller and has an internal heater. Furthermore, these rollers are driven by an unshown motor to convey the sheet 110. The second fixing device 160 is arranged downstream from the first fixing device 150 in the conveyance direction of the sheet 110. The second fixing device 160 performs functions such as applying gloss to the toner image on the sheet 110 that has been fixed by the first fixing device 150 and ensuring its fixing qualities. In a same manner as the first fixing device 150, the second fixing device 160 also has a fixing roller 161, a pressure roller 162, and a second post-fixing sensor 163. Depending on the type of sheet 110, it may not be necessary for it to pass through the second fixing device 160. In this case, for the purpose of reducing energy consumption, the sheet 110 passes through a conveyance route 130 without passing through the second fixing device 160. A conveyance route switching flapper 131 functions as a switching unit that switches the sheet 110 so that it is guided to the conveyance route 130 or guided to the second fixing device 160.

A conveyance route switching flapper 132 is a guiding member that guides the sheet 110 to a discharging route 135 or guides it outside to a discharging route 139. A reversing sensor 137 is provided on the discharging route 135. A leading edge of the sheet 110 passes through the reversing sensor 137 and is conveyed to a reversing unit 136. When the reversing sensor 137 detects a trailing edge of the sheet 110, the conveyance direction of the sheet 110 is switched. A conveyance route switching flapper 133 is a guiding member that guides the sheet 110 to a conveyance route 138 for double sided image forming or guides it to a discharging route 135. A conveyance route switching flapper 134 is a guiding member that guides the sheet 110 outside to a discharging route 139. It should be noted that multiple conveyance rollers 140 are provided on the conveyance paths of the discharging route 135 and discharging route 139 and the like.

A color sensor 200 that detects the test patterns on the sheet 110 is positioned downstream from the second fixing device 160 in the conveyance direction of the sheet 110. The color sensor 200 is downstream from the first fixing device 150 and the second fixing device 160 in the conveyance direction of the sheet 110 and functions as a measurement unit that measures the color of the image fixed to the sheet 110. The color sensor 200 may also be positioned on the discharging route 139. When color detection is instructed through an instruction from an operation panel 180, the engine control CPU 102 executes density correction, tone correction, and color correction and the like.

Figure 2:
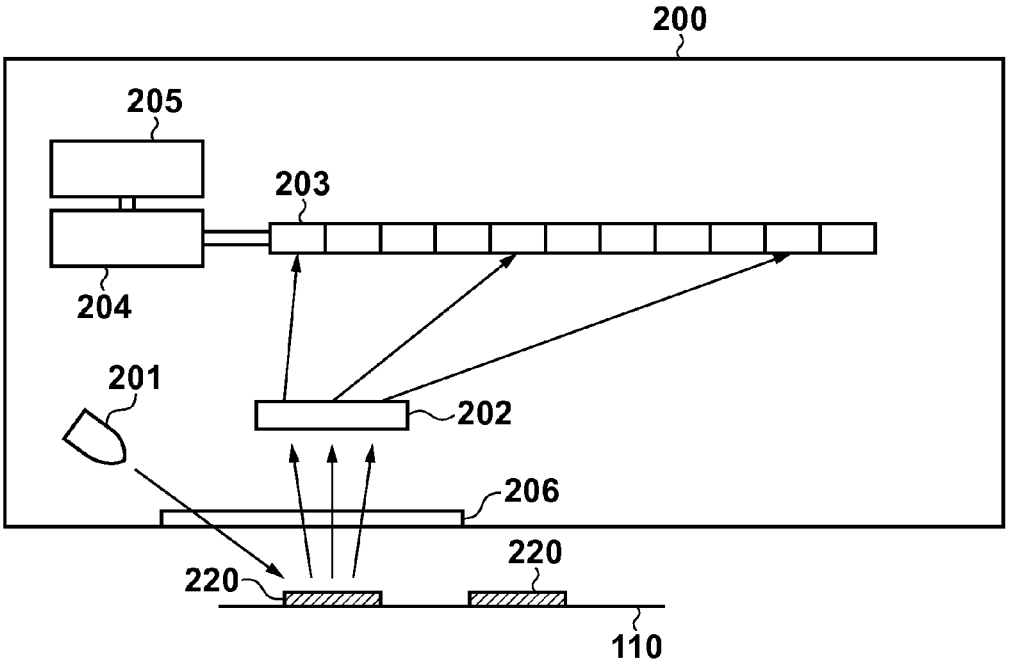
FIG. 2 is an outline structural view of a spectral type color sensor according to one embodiment.

FIG. 2 is a diagram showing a structure of the color sensor 200. A white LED 201 is a light emitting element that irradiates light onto the test patterns 220 on the sheet 110. A diffraction grating 202 is a spectral component that disperses into separate wavelengths the light that has been reflected from the test patterns 220 and passed through a window 206. A line sensor 203 is a photo detection element provided with n light receiving elements that detect the light that has been separated into separate wavelengths by the diffraction grating 202. A calculation unit 204 carries out various calculations from light intensity values of the pixels detected by the line sensor 203. A memory 205 stores various data that is to be used by the calculation unit 204. For example, the calculation unit 204 has units such as a spectral calculation unit that performs spectral calculations from light intensity values and a Lab calculation unit that calculates Lab values. Furthermore, a lens may be further provided so as to condense the light irradiated from the white LED 201 onto the test patterns 220 on the sheet 110 and condense the light reflected from the test patterns 220 onto the diffraction grating 202. The color sensor 200 measures the color of the test patterns 220 that are being conveyed by the conveyance unit (conveyance rollers 140) that convey the sheet 110. It should be noted that in a case where multiple color sensors 200 are installed inside the image forming apparatus 100, it is possible for only a single pair of the calculation unit 204 and the memory 205 to be provided for the multiple color sensors 200. This is because in this way it is possible to merge and execute the processing related to the measurement values from the multiple color sensors 200 and reduce the load on the printer controller 103. Furthermore, since the number of components can be reduced, it is also possible to achieve an effect of reducing manufacturing costs.

Figure 3:
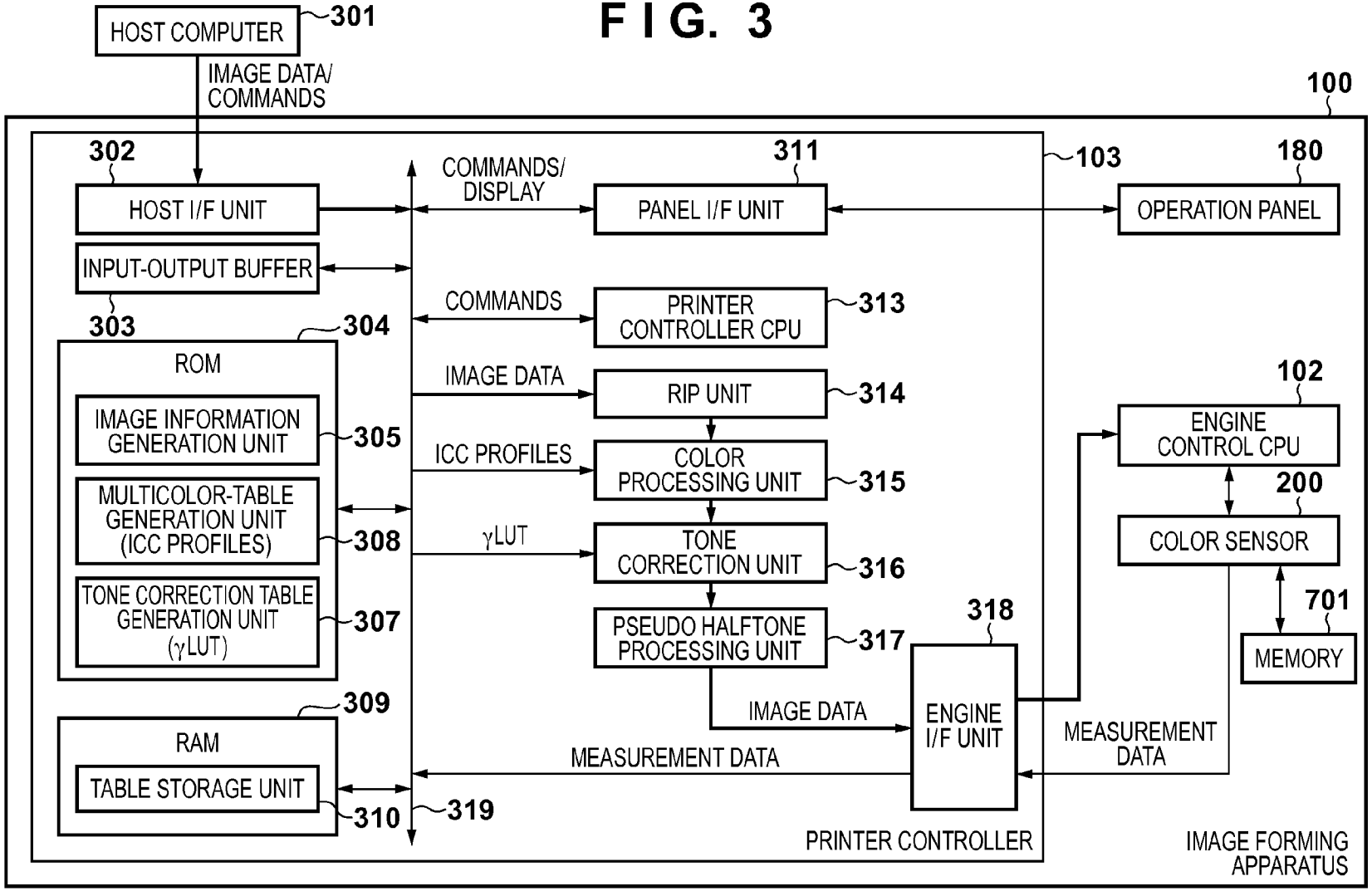
FIG. 3 is an outline structural view of an image processing unit according to one embodiment.

FIG. 3 is a block diagram showing a configuration of a control unit. A host computer 301 is a computer that transmits print jobs to the image forming apparatus 100 via a wire or wireless communications link. The printer controller 103 works in cooperation with the engine control CPU 102 to control the operations of the image forming apparatus 100. Each of the units that constitute the printer controller 103 is connected to each other via a bus 319.

A host I/F unit 302 is a communications unit that administers input and output of the host computer 301. An input-output buffer 303 stores control codes from the host I/F unit 302 and accumulates data from each of the communications units. A printer controller CPU 313 is a main processor that performs comprehensive control of the overall operations of the printer controller 103. A ROM 304 is a memory that stores a control program and control data and the like of the printer controller CPU 313. Functions that are achieved by the printer controller CPU 313 executing this control program include, for example, an image information generation unit 305, a tone correction table generation unit 307, and a multicolor-table generation unit 308. The multicolor-table generation unit 308 generates color matching profiles by executing an ICC profile generation method such as that described in Japanese Patent Laid-Open No. 2009-004865. A RAM 309 is a memory used as a work area for interpreting control codes and data, performing calculations necessary for printing, and processing print data. A table storage unit 310 is provided in the RAM 309 for storing ICC profiles generated by the multicolor-table generation unit 308 and tone correction tables (γLUTs) created by the tone correction table generation unit 307. The image information generation unit 305 generates various types of image objects (test patterns and the like) in accordance with settings information received from the host computer 301. A RIP (raster image processor) unit 314 is a processor that expands image objects into bitmap images. A color processing unit 315 carries out color conversion processing in accordance with color profiles such as the ICC profiles generated by the multicolor-table generation unit 308. A tone correction unit 316 executes single-color tone corrections using the tone correction tables (γLUTs) created by the tone correction table generation unit 307. A pseudo halftone processing unit 317 performs pseudo halftone processing on the image data using a dither matrix or an error diffusion technique or the like. An engine I/F unit 318 is a communications unit by which image data is transferred to the engine control CPU 102. The engine control CPU 102 controls the four stations 120, 121, 122, and 123 in accordance with the image data. Data for determining measurement timings of the test patterns for color corrections that are to be described later is stored in a memory 701.

The operation panel 180 is constituted by a display device and an input device and performs such functions as input of execution instructions of printing and correction processing and display of information to an operator. A panel I/F unit 311 connects the operation panel 180 and the printer controller 103.

The printer controller CPU 313 manages the ICC profiles and γLUTs that are used during image forming, and enables output of the desired color by updating these when necessary and reflecting these to the color processing unit 315 and the tone correction unit 316 and the like. The printer controller CPU 313 executes updates of the ICC profiles in the multicolor-table generation unit 308 by giving update instructions to the multicolor-table generation unit 308. Similarly, the printer controller CPU 313 executes updates of the γLUTs in the tone correction table generation unit 307 by giving update instructions to the tone correction table generation unit 307.

FIG. 4 is a graph showing characteristics relating to 81 types of test patterns. According to the ISO 12642 test form, 928 types of test patterns are necessary, but if the invention described in Japanese Patent Laid-Open No. 2009-004865 is used, a reduction is possible down to 81 types of test patterns. The parameters that the 81 types of test patterns indicate are CMYK signal values, an accumulations setting, an averaging process execution count, and pattern size. The CMYK signal value is 0, 50, or 100 and indicates an amount of applied toner. The accumulation setting indicates an exposure time necessary for the test pattern to be read correctly. The averaging process execution count is the number of samples necessary for obtaining an average value in regard to a certain test pattern. The pattern size is the length of the test pattern in the conveyance direction.

In this way each test pattern is formed on the sheet 110 so as to become a predetermined size in response to the CMYK signal values required for multicolor color corrections, and is measured using predetermined sensor settings (accumulation time and averaging process execution count). The size of the test patterns and the sensor settings are set in advance so that highly precise measurements can be carried out.

On the other hand, it is desirable that the number of sheets 110 on which the test patterns are formed is reduced as much as possible. This is because if the number of sheets on which the test patterns are formed is increased, more time is taken for outputting the test patterns and the downtime for the user is increased. Naturally, this also undesirably increases the number of sheets 110 that are required. Downtime here refers to the time (waiting time) in which the user cannot form images using the image forming apparatus 100.

Here, description is given regarding a method that enables measurement values to be calculated highly precisely while reducing the number of sheets 110 on which the test patterns are formed. It should be noted that the measurement speeds, pattern sizes, and sensor settings described below are one example and that the present invention is in no way limited to these.

First, the sheet conveyance direction size of the test patterns is calculated according to the following expression.

$$S=PS\times t\times N$$

Here, PS is the conveyance speed (mm/s) of the sheet on which the test patterns are formed. And "t" is the accumulation time (s) required for the light amount of the reflected light from the test pattern that is incident on the color sensor 200 from within each of the test patterns to become the appropriate light amount. N is the number of measurements required for unevenness of micro regions within each of the test patterns to be averaged. To facilitate ease of description in the present working example, the PS is assumed to be 250 mm/s. The accumulation time t and the averaging process execution count N vary depending on the test pattern. As shown in FIG. 4, the accumulation time t setting (accumulation setting) has three gradients (three levels) and the appropriate value is set for each of the test patterns.

Accumulation setting 1: 3 ms

Accumulation setting 2: 6 ms

Accumulation setting 3: 12 ms

Here, description is given regarding a method for determining the accumulation setting for each of the test patterns. A comparison will be made in regard test patterns having dark densities (dark areas) and test patterns having light densities (bright areas) in FIG. 4.

Figure 5A:
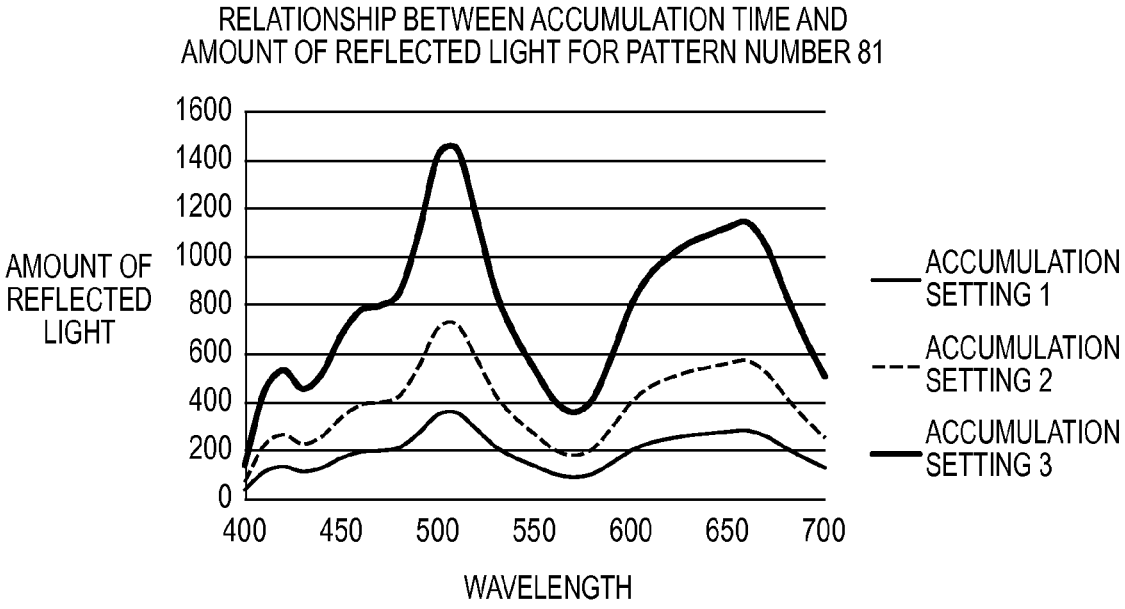
FIG. 5A and FIG. 5B are diagrams showing single examples of reflected light amounts according to differences in accumulation times.
Figure 5B:
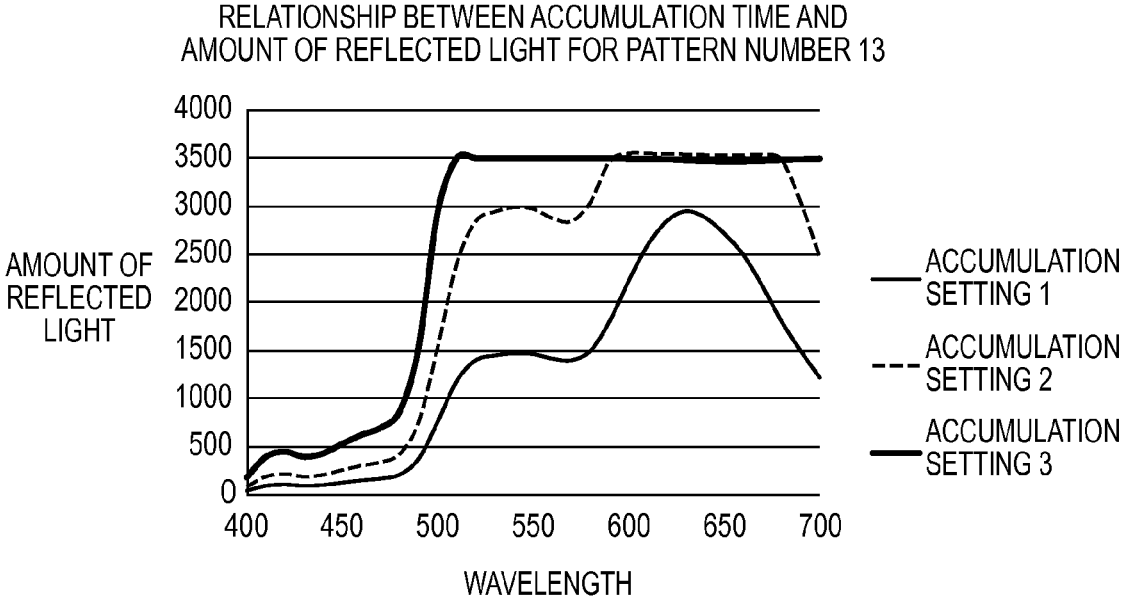

FIG. 5A and FIG. 5B are diagrams showing a relationship between accumulation time differences and reflected light amounts. The horizontal axis indicates wavelength and the vertical axis indicates the reflected light amount. In particular, FIG. 5A shows a relationship between the accumulation time and the reflected light amount for the test pattern whose pattern number is 81, which is a representative example of a dark area test pattern. FIG. 5B shows a relationship between the accumulation time and the reflected light amount for the test pattern whose pattern number is 13, which is a representative example of a bright area test pattern. It should be noted that in FIG. 5A and FIG. 5B the reflected light amounts are shown for the three accumulation settings.

Here, in regard to the reflected light amounts, dark output values are subtracted from the light amount of the reflected light from the test pattern incident on the color sensor 200. Dark output value refers to the output value from the color sensor 200 obtained when the light source of the color sensor 200 is not emitting light.

As shown in FIG. 5A, in regard to the 81st dark area test pattern, it is evident that the reflected light amount also increases when the accumulation time is increased. Furthermore, it can be judged that the accumulation setting 3 is appropriate for the 81st dark area test pattern. Generally, in a case where the reflected light amount is small, the proportion that noise components occupy in the electrical signal increases. Accordingly, the accumulation setting 3 for which the greatest possible dynamic range is obtainable is considered appropriate.

On the other hand, it can be judged that the accumulation setting 1 is appropriate for the bright area test pattern number 13. Incidentally, when the wavelength is approximately 600 nm or above with the accumulation setting 2, the reflected light amount becomes saturated. With the accumulation setting 3, the reflected light amount becomes saturated when the wavelength is approximately 500 nm or above. This is caused by the amount of reflected light plateauing at around 3500 due to the fact that the signal value indicating the amount of reflected light is limited to 4096, and the fact that the dark output value is 596.

In this way, appropriate accumulation times exist for the 81 test patterns used in multicolor corrections. The appropriate accumulation settings for the test patterns used in the present working example are as illustrated in FIG. 4. An appropriate accumulation setting for each of the test patterns is determined in advance at the factory at the time of shipping and stored in the ROM 304.

Next, description is given regarding the averaging process execution count N. The averaging process execution count N is the number of measurements (number of samples) required for unevenness of micro regions within each of the test patterns to be averaged. The measurement precision is improved by appropriately adjusting the averaging process execution count N. In the present working example, the setting of the averaging process execution count N is set to three levels (for example 4 times, 8 times, and 16 times) and an appropriate value is selected for each test pattern. An appropriate averaging process execution count N for each of the test patterns is determined in advance at the factory at the time of shipping and stored in the ROM 304.

Figure 6:
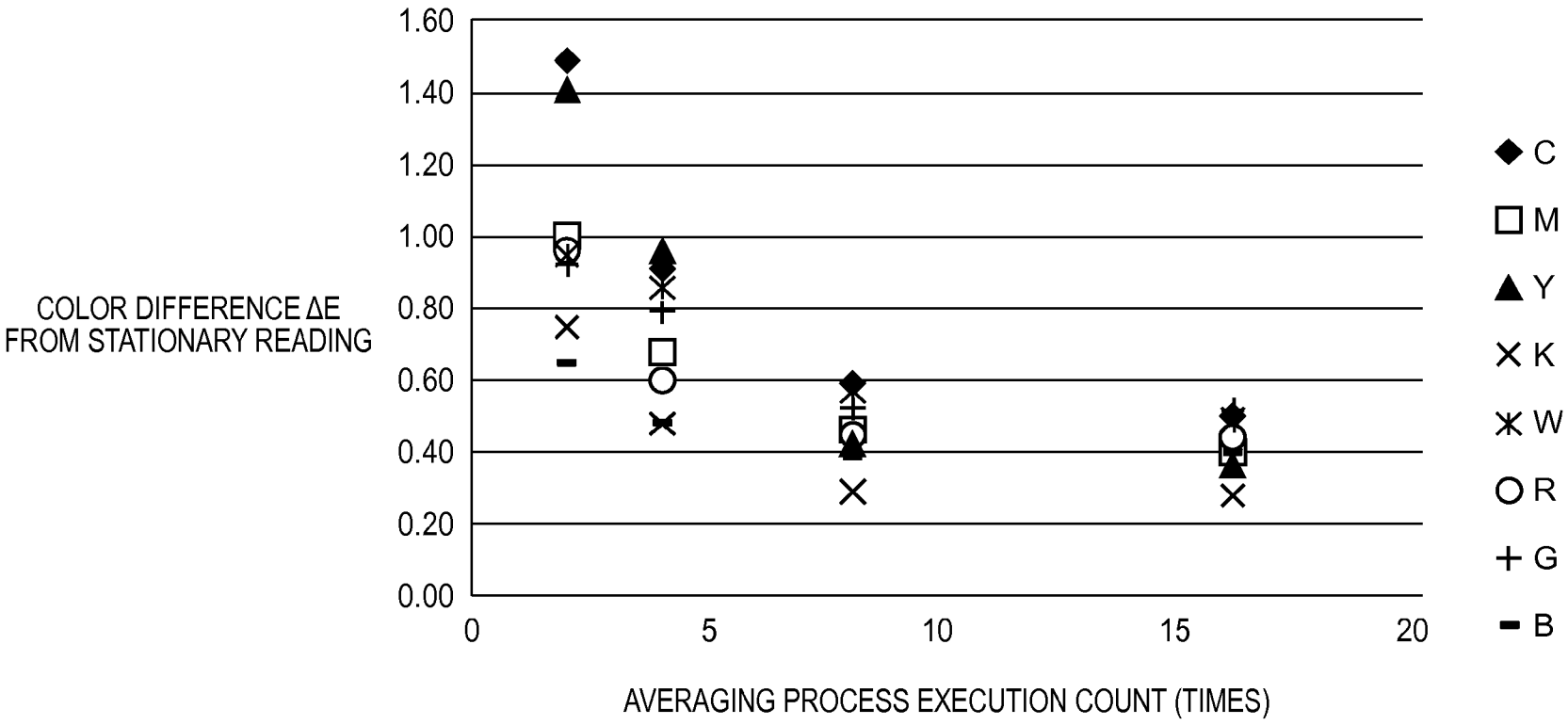
FIG. 6 is a diagram showing a relationship between an averaging process execution count and a color difference ΔE.

FIG. 6 shows a relationship between the averaging process execution count N and a color difference ΔE of CMYKWRGB test patterns. CMYKWRGB indicates cyan, magenta, yellow, black, white, red, green, and blue. The vertical axis indicates a color difference ΔE between a value measured when the CMYKWRGB test patterns are in a stationary state and a value when the test patterns are measured while the sheet 110 on which the test patterns are formed is being conveyed. The horizontal axis is the averaging process execution count N. This is the number of measurement values used when the test patterns are measured while the sheet 110 is being conveyed and the average value of the measurement values of the test patterns is calculated (also referred to as a number of times of measurement or a sample number). It should be noted that FIG. 6 also shows for comparison the color difference data for a case in which the averaging process execution count is two times.

As is evident from FIG. 6, when the averaging process execution count N is increased, the color difference ΔE with respect to stationary reading becomes smaller. That is, it is evident that when the averaging process execution count N is increased, the measurement precision rises.

It is evident that in the low-brightness test patterns of black (K) and blue (B), the amount of change in the color difference ΔE is small compared to other high-brightness test patterns. This is most conspicuous when the averaging process execution count is 8 times and 16 times. Since the accumulation time is long for low-brightness test patterns, the region to be measured is wider compared to the measurement regions of other test patterns. Thus, low-brightness test patterns can be detected easily with high precision even in a case where the averaging process execution count is small.

Verifications such as the above were carried out for all 81 test patterns for multicolor corrections and appropriate averaging process execution counts were obtained for these respectively. The averaging process execution count shown in FIG. 4 is one example of this. Further still, the pattern sizes in FIG. 4 show test pattern sizes required for satisfying the accumulation setting and the averaging process execution count determined for each test pattern.

Figure 7:
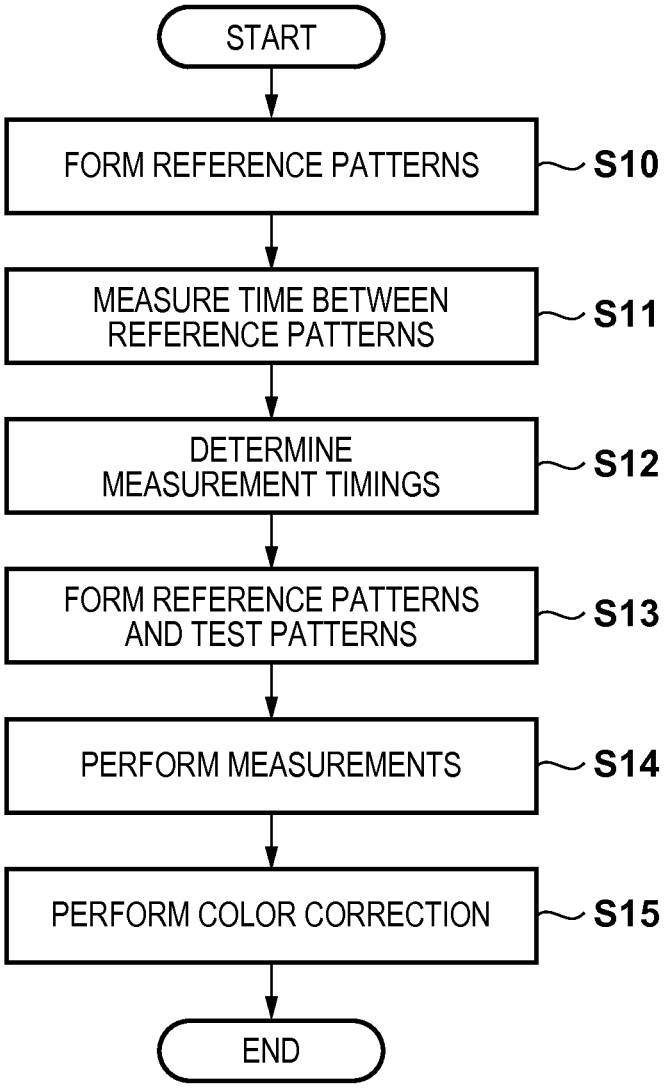
FIG. 7 is a flowchart of a test pattern measurement process according to one embodiment.

Next, description is given using FIG. 7 regarding a test pattern measurement process by the color sensor 200 according to the present embodiment. At step S10, the engine control CPU 102 forms reference patterns 501*a* and 501*b* shown in FIG. 8A on the sheet 110. The colors used on the reference patterns 501*a* and 501*b* are arbitrary. It should be noted that the reference pattern 501*a* is formed near the conveyance direction leading edge of the sheet 110 and the reference pattern 501*b* is formed near the conveyance direction trailing edge of the sheet 110. At step S11 the engine control CPU 102 measures a time T1 from when the color sensor 200 detects the reference pattern 501*a* until it detects the reference pattern 501*b*, that is, it measures a time interval between the reference pattern 501*a* and the reference pattern 501*b*.

Figure 8B:
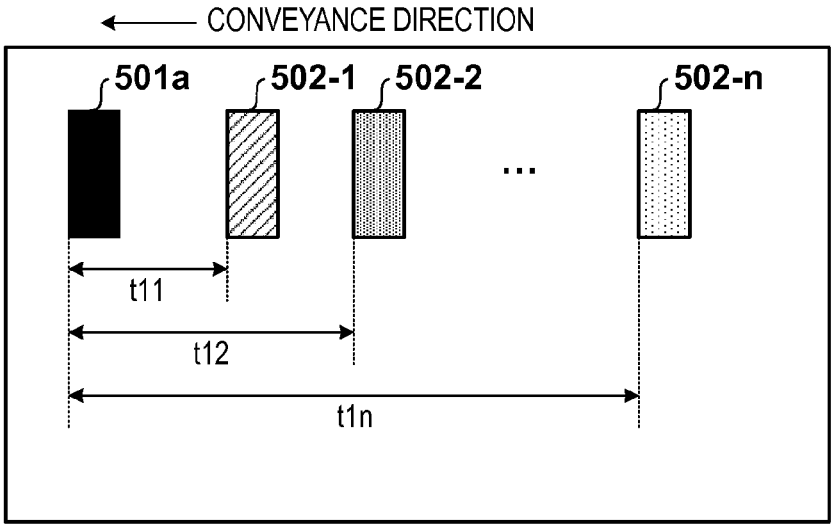
Figure 9:
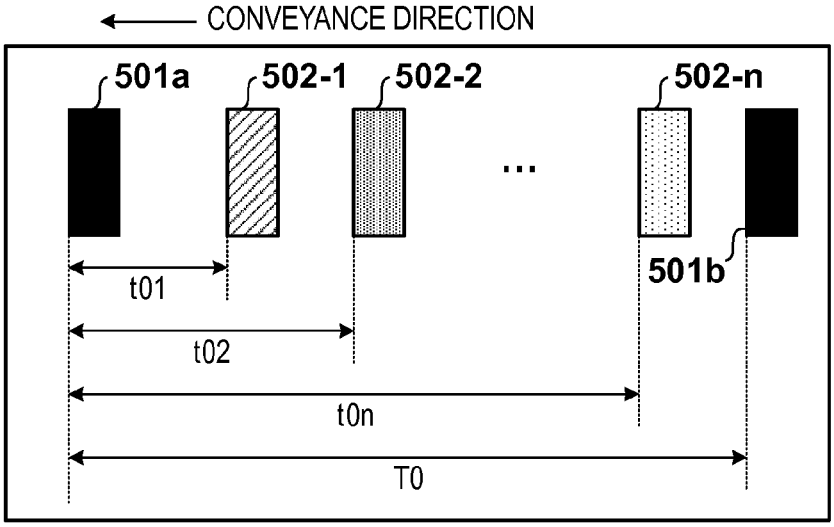
FIG. 9 is a diagram for describing determining measurement timings of test patterns according to one embodiment.

As shown in FIG. 9, the memory 701 stores a reference interval T0, which is the time from when the reference pattern 501*a* is detected until the reference pattern 501*b* is detected when the conveyance of the sheet 110 is in an ideal state. Further still, the memory 701 stores reference intervals t01, t02, . . . , and t0*n*, which are the times from when the reference pattern 501*a* is detected until the test patterns 502-1, 502-2, . . . , and 502-*n* of each color are detected when the conveyance of the sheet 110 is in an ideal state. At S12, from information stored in the above-mentioned memory 701 and the time T1 measured at step S11, the engine control CPU 102 determines measurement timings t11, t12, . . . , and tin of the test patterns 502-1, 502-2, . . . , and 502-*n*. As shown in FIG. 8B, the measurement timings are time intervals from when the reference pattern 501*a* is detected, and these are obtained respectively from the following expression (1).

$$t1k=t0k\times(T1/T0)\ (k=1\text{ to }n) \tag{1}$$

Figure 8A:
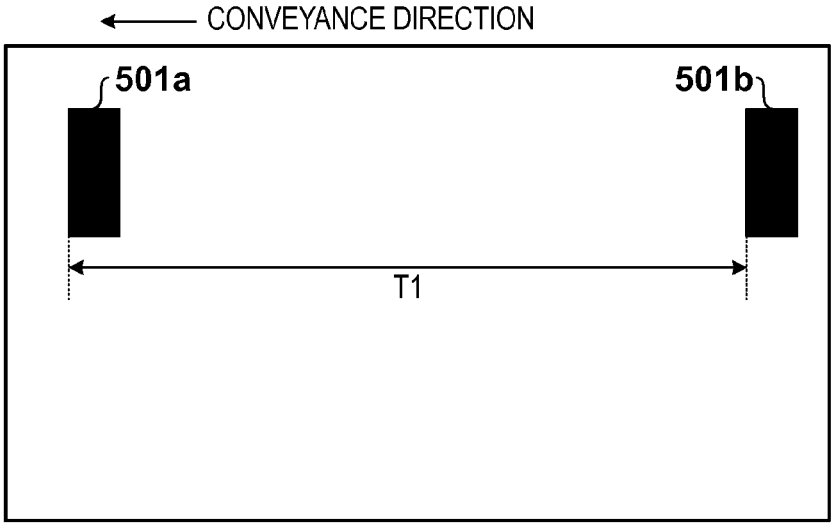
FIG. 8A and FIG. 8B are diagrams for describing determining measurement timings of test patterns according to one embodiment.

As shown in FIG. 8B, at step S13 the engine control CPU 102 forms the reference pattern 501*a* and the test patterns 502-1 to 502-*n* on a next sheet 110 (second sheet) after the sheet 110 (first sheet) shown in FIG. 8A. Specifically, each test pattern is formed on the trailing side of the reference pattern 501*a* in the conveyance direction of the sheet 110. And at step S14, the color of each test pattern formed on the sheet 110 shown in FIG. 8B is measured with the timings determined at step S12. The engine control CPU 102 carries out color correction at step S15 based on the measurement results.

Thus, based on the detection interval of the reference patterns 501*a* and 501*b* and the reference interval of the reference patterns 501*a* and 501*b*, the reference interval between the reference pattern 501*a* and each of the test patterns is corrected and the measurement timing of each test pattern is determined. With this configuration, it becomes unnecessary to increase the size of the test patterns in consideration of the effect of speed fluctuations of the sheet 110, and the size of each of the test patterns can be made small. Consequently, it is possible to increase the number of test patterns that can be formed on a single sheet 110. Due to this, it is possible for example to form all the required test patterns on a single sheet 110 and accordingly the color measurement precision can be improved. It should be noted that in a case where it is necessary to form the test patterns extending over multiple sheets, it is possible to form the test patterns on the sheets as shown in FIG. 8B and determine the measurement timings of the test patterns of each sheet according to the time T1 of the reference patterns 501*a* and 501*b* that are initially measured.

It should be noted that in the present embodiment, the measurement timings of test patterns are determined for color corrections, but the present invention can also be applied for determining measurement timings of test patterns for correcting the densities formed on the sheet 110. Further still, in the foregoing embodiment, the memory 701 stored times as the reference intervals, but embodiments are possible in which distances are stored. In this case, the distance between reference patterns is obtained from the detection result of the color sensor 200, and the measurement timing for each test pattern is determined using expression (1).

Second Embodiment

Figure 10:
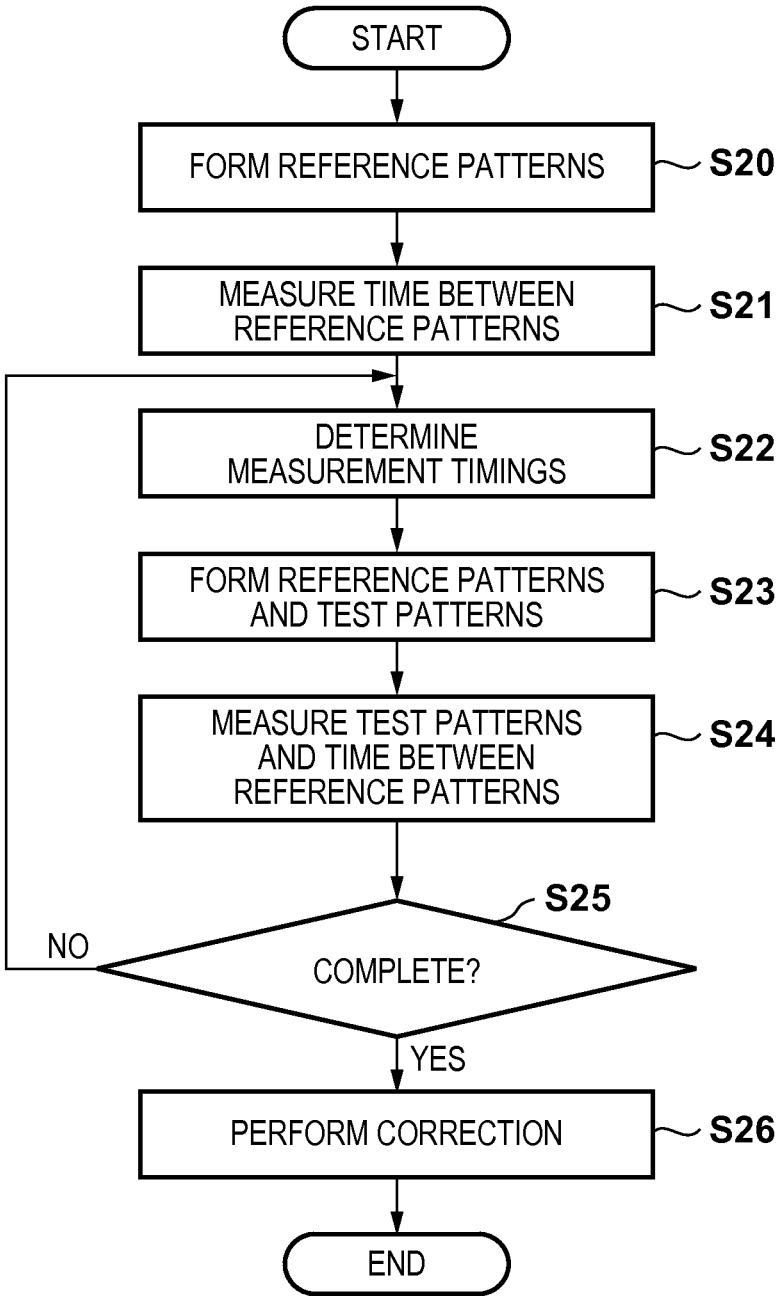
FIG. 10 is a flowchart of a test pattern measurement process according to one embodiment.

There are times when it is necessary to form the test patterns on multiple sheets 110, such as cases where the size of the sheet 110 is small and cases where many test patterns are to be formed for highly precise corrections. Hereinafter, description is given using FIG. 10 regarding test pattern color measurements in a case where test patterns are formed on multiple sheets 110. It should be noted that in the following description, as one example, the number of test patterns that can be formed on a single sheet 110 is set to five, and the number of test patterns required to be formed is greater than five.

Figure 11A:
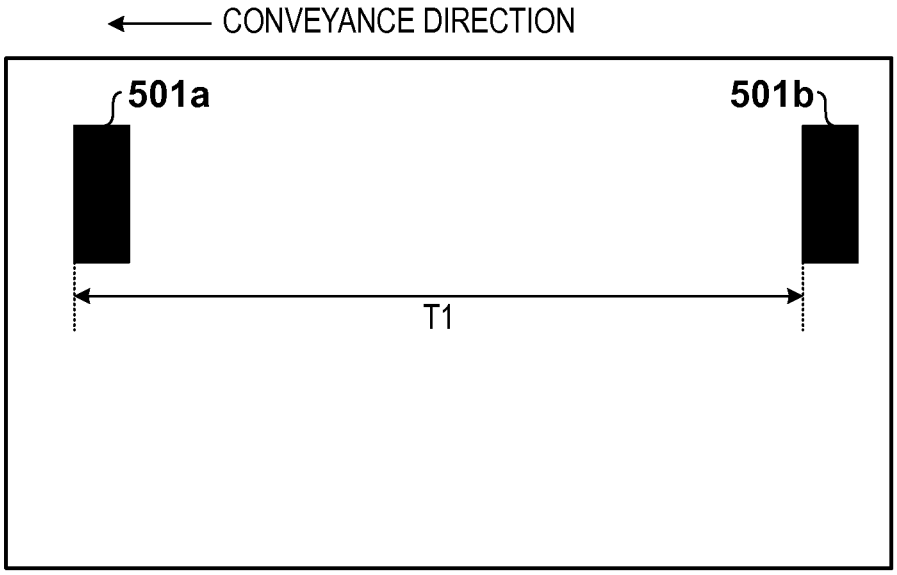
FIG. 11A and FIG. 11B are diagrams for describing determining measurement timings of test patterns according to one embodiment.
Figure 11B:
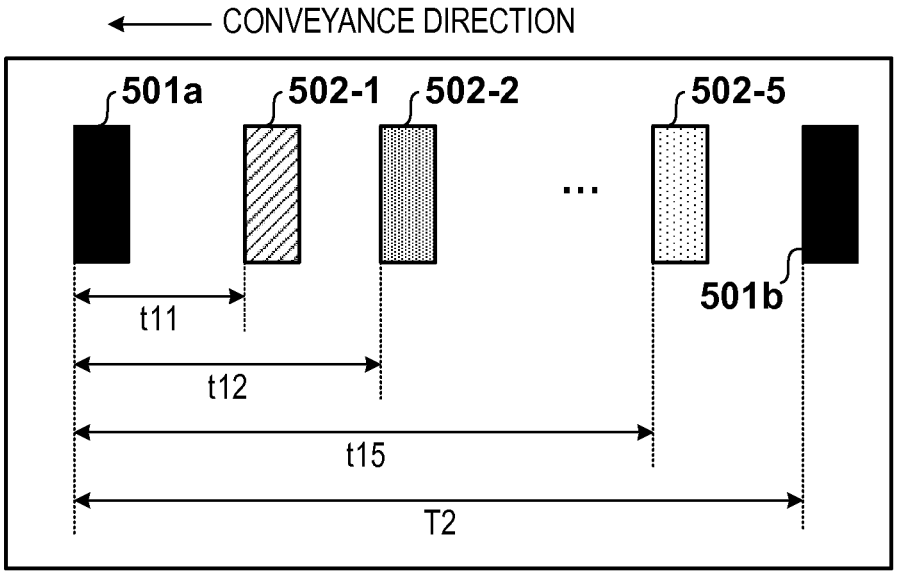

At step S20, the engine control CPU 102 forms the reference patterns 501*a* and 501*b* shown in FIG. 11A on the sheet 110. It should be noted that the reference pattern 501*a* is formed near the conveyance direction leading edge of the sheet 110 and the reference pattern 501*b* is formed near the conveyance direction trailing edge of the sheet 110. At step S21 the engine control CPU 102 measures the time T1 from when the color sensor 200 detects the reference pattern 501*a* until it detects the reference pattern 501*b*. As shown in FIG. 9, the memory 701 stores the time T0, which is the time from when the reference pattern 501*a* is detected until the reference pattern 501*b* is detected when the conveyance of the sheet 110 is in an ideal state. Further still, the memory 701 stores the times t01, t02, . . . , and t0*n*, which are from when the reference pattern 501*a* is detected until each of the test patterns 502-1, 502-2, . . . , and 502-*n* are detected when the conveyance of the sheet 110 is in an ideal state. At step S22, from information stored in the above-mentioned memory 701 and the time T1 measured at step S21, the engine control CPU 102 determines measurement timings t11 to t15 of the respective test patterns 502-1 to 502-5. As shown in FIG. 11B, the measurement timings are times from when the reference pattern 501*a* is detected, and these are obtained respectively from the following expression (2).

$$t1k=t0k\times(T1/T0)\ (k=1\text{ to }5) \tag{2}$$

At step S23 the engine control CPU 102 forms the reference patterns 501*a* and 501*b* and the test patterns 502-1 to 502-5 on the next sheet 110 and, at step S24, the color of each test pattern is measured using the measurement timings determined at step S22. Furthermore, in the present embodiment, the time T2 from when the reference pattern 501*a* is detected until the reference pattern 501*b* is detected is also measured at this time as shown in FIG. 11B. At step S25, the engine control CPU 102 determines whether or not all the test patterns have been measured and if they have not all been measured the procedure returns to step S22 and the measurement timings of the test patterns 501-6 to 501-10 to be formed next are determined. It should be noted that at this time, the time T2 measured at the previous step S24 is used as an actual measurement of from when the reference pattern 501*a* is detected until the reference pattern 501*b* is detected. Accordingly, each of the measurement timings is as obtained from the following expression (3).

$$t1k=t0k\times(T2/T0)\ (k=6\text{ to }10) \tag{3}$$

Subsequently, the processing from step S22 to step S24 is iterated in a same manner until all the test patterns are measured, but in iterations from the second time onward, the measurement timings in step S22 are determined using the detection time between the reference patterns 501*a* and 501*b* measured at the previous step S24. And when the measurements of all the test patterns are completed, the engine control CPU 102 carries out color correction at step S26 based on the measurement results.

In the foregoing present embodiment, the measurement timings of the test patterns formed on each of the sheets 110 is determined according to the interval between the reference patterns formed on the one-previous conveyed sheet 110. With this configuration, even in a case where the test patterns are formed on multiple sheets 110, the measurement timings of the test patterns can be determined very accurately and thus the size of the test patterns can be reduced.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-032445, filed on Feb. 21, 2013 which is hereby incorporated by reference herein in its entirety.

What is claimed is:

1. An image forming apparatus, comprising:

an image forming unit configured to form a reference pattern and a test pattern on a sheet, a measurement unit configured to detect the reference pattern formed on the sheet and to measure the test pattern formed on the sheet, and a control unit configured to control a measurement timing of the test pattern by the measurement unit according to a detection interval between two reference patterns detected by the measurement unit.

2. The image forming apparatus according to claim 1, wherein the control unit is further configured to control a measurement timing of the test pattern by correcting a reference interval between one of the two reference patterns and the test pattern based on a detection interval between the two reference patterns detected by the measurement unit and a reference interval between the two reference patterns.

3. The image forming apparatus according to claim 1, wherein the control unit is further configured to control a measurement timing of test pattern formed on a second sheet, which is conveyed subsequent to a first sheet, according to a detection interval between two reference patterns formed on the first sheet detected by the measurement unit.

4. The image forming apparatus according to claim 3, wherein a plurality of types of test patterns are formed on the second sheet.

5. The image forming apparatus according to claim 3, wherein one of the two reference patterns formed on the first sheet and the test pattern are formed on the second sheet.

6. The image forming apparatus according to claim 5, wherein the test pattern is formed on a subsequent side from the reference pattern formed on the second sheet in the conveyance direction of the sheet.

7. The image forming apparatus according to claim 3, wherein two reference patterns and the test pattern are formed on the second sheet.

8. The image forming apparatus according to claim 7, wherein the test pattern is formed between the two reference patterns formed on the second sheet in the conveyance direction of the sheet.

9. The image forming apparatus according to claim 1, further comprising a conveyance unit configured to convey the sheet, wherein the measurement unit is further configured to measure the test pattern by detecting the reference pattern formed on the sheet that is conveyed.

10. The image forming apparatus according to claim 1, further comprising a correction unit configured to correct an image forming condition according to a measurement result of the test pattern by the measurement unit.

* * * * *